United States Patent [19]

Franzke

[11] 4,201,483

[45] May 6, 1980

[54] APPARATUS FOR TUMBLING FOODSTUFFS UNDER VACUUM

[75] Inventor: Jürgen Franzke, Bad Essen, Fed. Rep. of Germany

[73] Assignee: Röscherwerke GmbH, Osnabruck, Fed. Rep. of Germany

[21] Appl. No.: 960,646

[22] Filed: Nov. 14, 1978

[51] Int. Cl.[2] ..... B01F 9/02

[52] U.S. Cl. ..... 366/139; 366/214

[58] Field of Search ..... 366/139, 213, 214, 218; 99/348, 472, 483, 485; 68/140, 150; 51/164

[56] References Cited

U.S. PATENT DOCUMENTS

| | | | |
|---|---|---|---|
| 724,308 | 3/1903 | Marsh | 366/214 |
| 1,018,947 | 2/1912 | Wall | 366/213 |
| 2,021,261 | 11/1935 | Moore | 366/214 |
| 3,596,481 | 8/1971 | Wilcox | 68/150 |

FOREIGN PATENT DOCUMENTS

| | | | |
|---|---|---|---|
| 1008738 | 11/1965 | United Kingdom | 366/213 |

*Primary Examiner*—Philip R. Coe
*Attorney, Agent, or Firm*—Browdy and Neimark

[57] ABSTRACT

A tumbling machine for tumbling and agitating foodstuffs, for example, meat, fish, etc., under vacuum. The foodstuffs are placed in evacuable containers provided with wheels permitting the use of the containers as transport means. The tumbling machine has a substantially U-shaped frame which rotates around a horizontal axis in preferably interval-programmed rotation. For insertion and removal of the containers in the frame, the U-shaped frame is so positioned as to present its open end to the floor of the machine. In that position, the container is rolled into the frame along guide rails defining its lateral location. The depth of entry of the container into the frame is limited by the cooperation of symmetrically spaced guides on the outside of the containers, a pair of opposite guides on the containers cooperating with suitably positioned stops on the rotatable frame that limit the maximum entry of the containers and correctly position the containers with respect to the frame. When so positioned, vertical stops on the frame also prevent any vertical motion of the containers. The containers are locked in the frame by a pivotable locking bar that is secured by a screw or the like and whose center bears against the container, thereby immobilizing it. A safety frame surrounds the machine during operation and a safety switch cooperates with an access door to arrest the machine when the door is opened.

10 Claims, 5 Drawing Figures

APPARATUS FOR TUMBLING FOODSTUFFS UNDER VACUUM

FIELD OF THE INVENTION

The invention relates to a tumbling machine, i.e., an apparatus for moving and agitating foodstuffs in a container under vacuum, especially meat, fish, fowl, and the like.

BACKGROUND OF THE INVENTION

In known tumbling machines of the above-described type, the rigid connection between the one or more containers with the rotating apparatus requires substantial technical effort in construction and is difficult to manipulate, requiring numerous manual motons for inserting and removing the containers.

SUMMARY OF THE INVENTION

It is thus a principal object of the present invention to provide a tumbling machine for foodstuffs under vacuum which is relatively simple in construction and in which the containers may be inserted and affixed within the rotating machinery in simple manner requiring few manipulations which are rapidly executed.

It is a further object of the present invention to provide relatively simple means for attaching the containers to the rotatable machine in a reliable and secure manner.

Still another object of the invention is to protect the entire machine against unintentional access from the outside.

Yet another object of the invention is to so equip the containers in which the foodstuffs are tumbled as to serve independently as transport and storage containers.

These and other objects are attained according to the present invention by providing a tumbling machine with a stationary base on which is mounted a rotatable frame. The rotatable frame defines one or more spaces in which containers may be placed and the frame is further provided with a plurality of locating and guide means which cooperate with locating means on the containers so that, when containers are placed within the rotating frame, they automatically assume the intended location and position in which they may be secured by a pivotable locking bar. A safety shroud surrounds the machine and is provided with an access door equipped with a safety switch that interrupts the electric power when the door is opened.

Advantages deriving from the tumbling machine according to the present invention include the following.

The containers may be attached and secured within the rotating frame with a small number of easy steps and yet in a manner which is mechanically secure so as to insure the safe rotation of the containers in the, preferably interval-like, rotation of the rotating frame during operation. The locking bar which holds the container against the locating stop is pivotable at one end and may be secured with only a single screw in a rapid and reliable manner. Only one locking bar is provided and required for each container, thereby substantially reducing the cost of manufacture and the manipulation during the insertion of the container.

The rotating frame of the apparatus rotates about a horizontal axis which constitutes a transverse axis of the container in which the foodstuffs are tumbled. This rotation around a transverse axis of the container results in a particularly effective agitation of the contents because it entails an effective revolution of the container contents, especially in the corners defined by the container wall and the container base.

A further advantage is the fact that the containers may be used, in addition to tumbling, as transporting and storage containers due to the installation on their base of rollers or wheels.

The construction of the machine is such that the bottom of the rotating frame is unobstructed, permitting easy installation of the containers yet insuring unimpeded rotation of the entire apparatus.

Still further advantages will emerge from the following detailed description of the invention read in reference to the attached drawings.

DETAILED DESCRIPTION OF THE INVENTION

Figure 1:
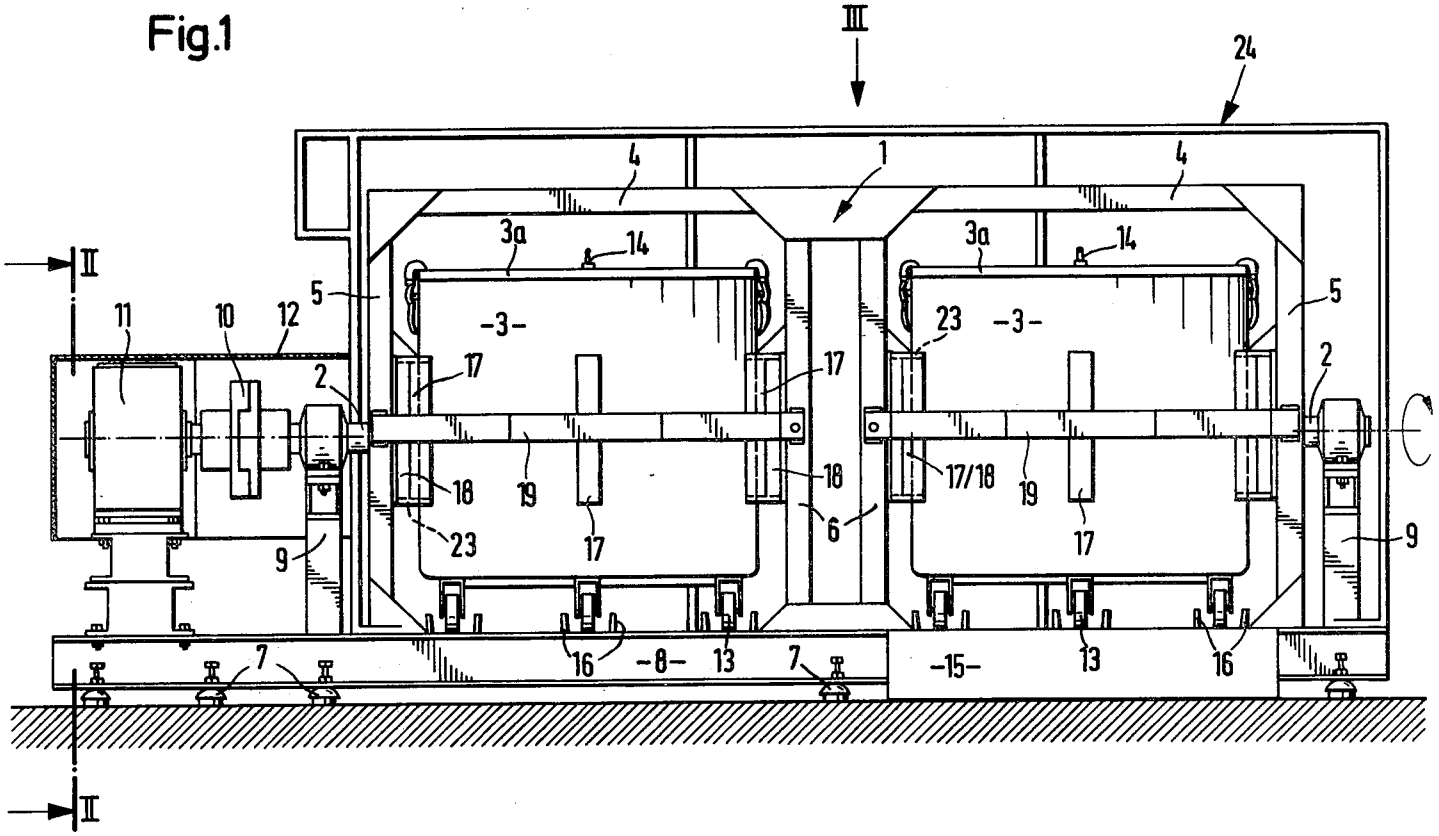
FIG. 1 is a front elevational view of a tumbling machine according to the invention with two removable containers.

The tumbling machine according to the invention which is especially suitable for the agitation and massaging of foodstuffs under vacuum, especially of meat, fish, fowl, and the like, includes as one of its principal elements a rotatable frame 1 capable of rotation around a horizontal axis defined by two shafts 2 extending from opposite lateral ends of the rotating frame 1. The rotatable frame 1 consists of a U-shaped frame made, for example, of tubes having preferably square or rectangular cross section. In the position shown in FIG. 1, which is the position of the rotating frame assumed for receiving one or more of the tumbling containers, the open end of the frame is adjacent to the base of the machine as shown. In that position, the rotating frame 1 is seen to be defined by an upper, horizontal, longitudinal beam 4 and two shorter vertical carrying beams 5 on which the extending shafts 2 are mounted to provide rotation. The relative length of the frame 1 may vary depending on the number of containers for which the machine is built. When, as illustrated in the example of FIG. 1, the machine is built for two adjacent containers 3, the frame 1 is further provided with two parallel central vertical beams 6 each of which is attached rigidly to the longitudinal beam 4. In this configuration the frame 1 consists of two parallel U-shaped sub-frames.

The tumbling machine has a base 8 which may be suitably provided with swiveling rollers 7, or the like, for providing movability over a floor surface. Extending vertically from the base 8 are two bearing supports 9 each of which is provided with a journal admitting the aforementioned shaft ends 2 to provide rotation therein. One of the shaft ends 2 is attached through a clutch 10 to the drive shaft of a geared motor 11 which serves as the power source for the rotation of the frame 1. A removable protective hood 12 surrounds the drive train 11,10.

The tumbling containers 3 are preferably substantially cylindrical and may have a capacity, for example, 1000 liters per container. In order to provide mobility of the containers over a horizontal surface, in particular for easy insertion of the containers within the machine, each of the containers has rollers 13 attached to its base, permitting the containers to be moved without effort both for insertion in the machine and as general transport and storage containers.

The top of each of the containers 3 may be sealed by a removable or hinged cover 3*a* in which a connection 14 is provided for removing air from the container by connection to a suitable source of vacuum and thereby subjecting the contents of the container to a vacuum.

Figure 2:
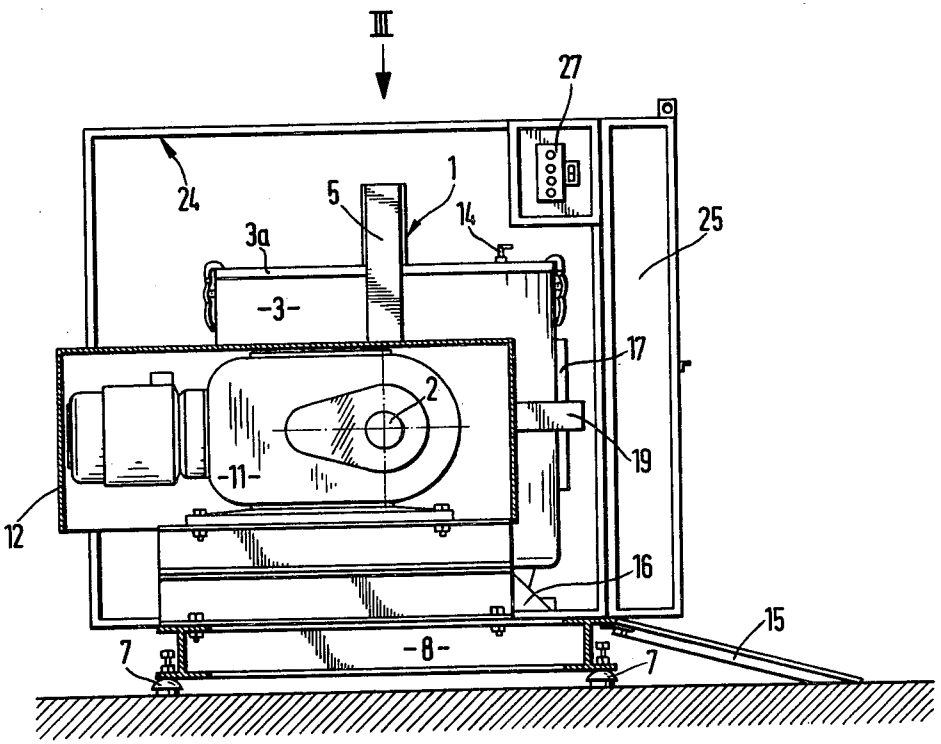
FIG. 2 is a side elevational view of the invention in partially sectional illustration.

As best seen in FIG. 2, the base 8 may be provided with an oblique ramp 15 to facilitate the entry and departure of the containers 3 to and from the machine. However, the containers 3 may also be placed within the machine by means of a fork lift truck or the like.

In order to insure the correct entry of the container into the machine, the base 8 is provided with guide rails 16 which admit the rollers 13 on the bottom of the container and assure the correct lateral position of the container during entry. In order to further define the correct final position of the container within the rotating frame, each container is provided with a plurality of externally protruding guides 17, preferably four guides, which are attached to the outer wall of each container symmetrically, i.e., with uniform spacing. These guides 17 may preferably be pieces of square or rectangular pipe which are preferably welded to the containers 3.

Figure 3:
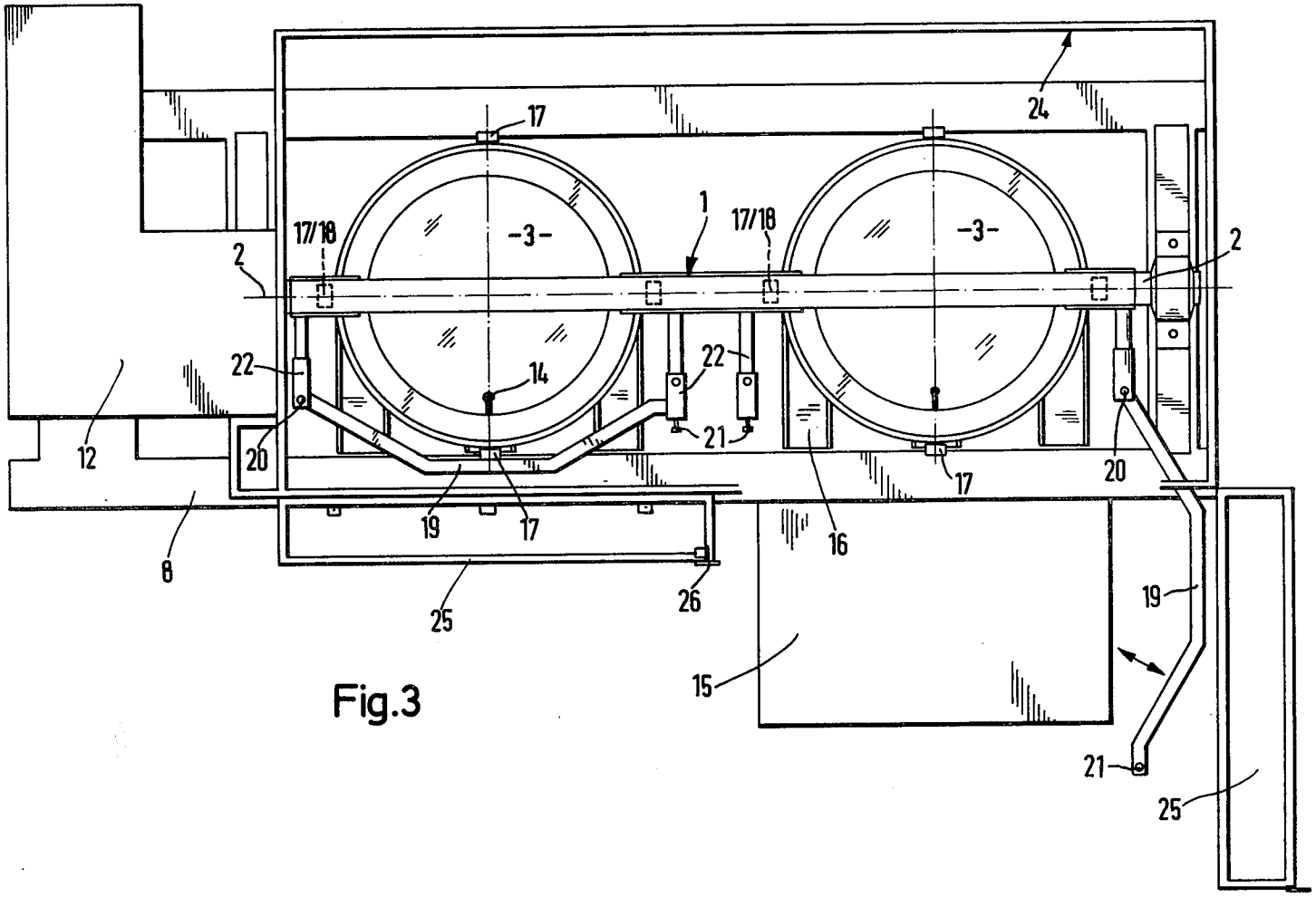
FIG. 3 is a top view of the tumbling machine according to the invention illustrating one container secured by the locking bar and the other unsecured by the locking bar.
Figure 4:
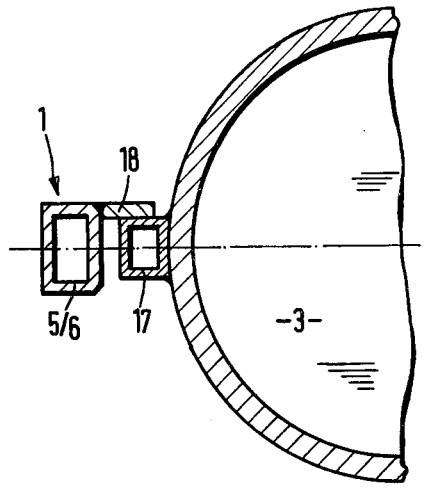
FIG. 4 is a horizontal section through the locating elements of one of the containers.
Figure 5:
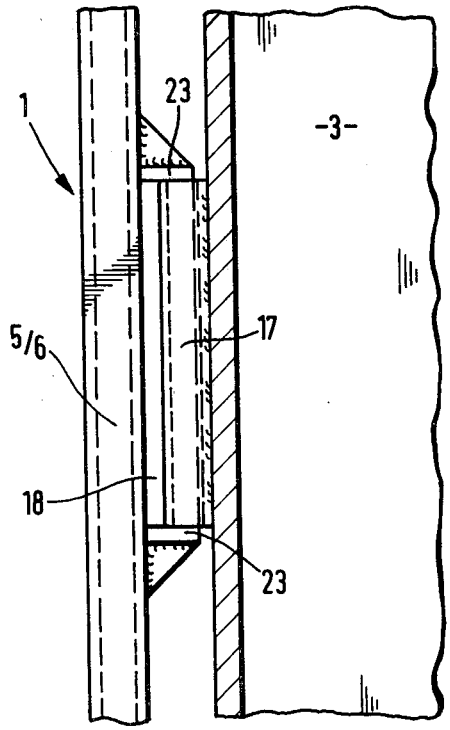
FIG. 5 is a side view of the locating elements for one of the containers.

Rigidly attached to each of the vertical beams 5, 6 is a stop member 18, for example in the shape of a flat piece of steel, against which two opposite guides 17 come to lie when the container is fully introduced into the machine. In that position, best seen in FIG. 3, the rotating frame 1 extends substantially across the center of each of the containers and the tubular guide protrusions 17 come to lie against the stops 18 attached to the rear edges of the beams 5,6. The cooperation of the guides 17 and the stops 18 is best seen in FIG. 4, in which it is seen that the depth to which the container 3 may be inserted in the machine is limited by the cooperation of the members 17,18. In order to hold the container 3 in this position, i.e., in particular to prevent its outward motion during operation, there is provided a locking bar 19, best seen in FIG. 3, the center of which makes contact with a third one of the protruding guides 17, thereby holding the container immovably in its intended position with respect to any lateral motion. The locking bar 19, which may be made of pipe of rectangular or square cross section and which is preferably bent so as to define a trapezoidal appearance, is pivoted at one end about a vertical axis 20 within the rotating frame 1. The other end of the locking bar 19 may be affixed in a suitable receiving member 22 attached to the vertical beams 5,6 with the aid of a locking member, for example a screw 21. In order to provide for the admission of containers of various sizes, the receiving member 22 may be extensible. The vertical position of the locking bar 19 is such as to be approximately at half the height of one of the containers while the central section thereof presses against a third one of the protruding guides 17. It will be appreciated that, inasmuch as each container 3 has four symmetrical guides 17, it could be introduced into the machine in the reversed rotational position, i.e., one which differs from the illustrated position by 180°. The cooperation of the members 17, 18, 19 insures the horizontal fixation of the containers 3 with respect to the rotating frame 1. In order to insure the vertical fixation, i.e., to define the vertical position of the containers 3 and, at the same time, to provide a rotational coupling to the frame, there are provided further stop members 23 which are preferably welded to the vertical beams 5,6 and which extend over the top and bottom ends of the protruding guides 17 which cooperate with the stops 18. The cooperation of the top and bottom stop members 23 with the guides 17 is best seen in FIG. 5. The stop members 23 may be flat pieces of steel which extend at right angles from the beams 5, 6 in the direction of the container to be received. The stop assembly consisting of the members 18 and 23 cooperates with the guides 17 to impart rotation to the containers 3 when the frame 1 rotates.

In order to prevent inadvertent access to the machine during operation, the machine has a safety frame 24 with a protective screen which prevents access to the rotating members 1, 3 of the machine during operation, thereby preventing accidents. The safety frame 24 has at least one access door 25 through which the container or containers 3 may be moved in and out of the tumbling machine. The access door 25 cooperates with a safety switch 26, preferably a magnetic switch, which interrupts the rotary motion of the frame 1 and its containers 3 as soon as the door 25 is opened, thereby stopping the entire machine.

Further mounted on the safety frame 24 is a control mechanism 27 which regulates the rotary motion of the containers around their horizontal axis. The rotary motion may be continuous or according to a programmed series of partial rotation at suitable intervals.

The foregoing description relates to preferred examples of the invention and other embodiments and variants are possible without departing from the spirit and scope of the invention.

I claim:

1. A tumbling machine for agitating and massaging foodstuffs under vacuum, comprising:

a base;

upstanding bearing posts mounted on said base and equipped with journals;

a rotatable frame, provided with extending coaxial shafts residing in said journals to permit rotation of said frame around a normally horizontal axis, said frame defining at least one space in which may be placed at least one container for said foodstuffs;

means, coupled to said rotatable frame, for imparting rotary motion to said frame around said axis;

at least one container for said foodstuffs, said container having guide means for insuring the location and position thereof in said rotatable frame, said guide means being defined by a plurality of uniformly spaced protruding guides fixedly mounted on the outside wall of said container, said container being provided with means for evacuating air therefrom;

said rotatable frame is provided with stop means so located that, when said container is placed in the space defined in said rotatable frame, at least some of said protruding guides come into contact with said stop means to thereby prevent further motion of said container with respect to said frame in the direction of entry;

a locking bar member for locking said container in said frame to prevent motion thereof with respect to said frame at least in the direction opposite to entry, said locking bar being held pivotably at one end thereof on said frame, the other end of said locking bar being removably attachable to another part of said frame, thereby causing its central portion to bear against and immobilize said container;

wherein said locking bar is a tube of substantially rectangular cross section bent into a trapezoidal shape, one end of which pivots about a vertical axis on said rotatable frame while the other end is removably attachable to another part of said frame by a screw, the central portion of said locking bar bearing against one of said protruding guides when locked into place.

2. A tumbling machine according to claim 1, further comprising receiver means extending from said rotatable frame in the direction opposite the direction of entry of said container and cooperating with the non-pivoting end of said locking bar to receive said locking screw.

3. A tumbling machine for agitating and massaging foodstuffs under vacuum, comprising:

a base;

upstanding bearing posts mounted on said base and equipped with journals.

a rotatable frame, provided with extending coaxial shafts residing in said journals to permit rotation of said frame around a normally horizontal axis, said frame defining at least one space in which may be placed at least one container for said foodstuffs;

means, coupled to said rotatable frame, for imparting rotary motion to said frame around said axis;

at least one container for said foodstuffs, said container having guide means for insuring the location and position thereof in said rotatable frame, said guide means being defined by a plurality of uniformly spaced protruding guides fixedly mounted on the outside wall of said container, said container being provided with means for evacuating air therefrom;

said rotatable frame is provided with stop means so located that, when said container is placed in the space defined in said rotatable frame, at least some of said protruding guides come into contact with said stop means to thereby prevent further motion of said container with respect to said frame in the direction of entry;

a locking bar member for locking said container in said frame to prevent motion thereof with respect to said frame at least in the direction opposite to entry, said locking bar being held pivotably at one end thereof on said frame, the other end of said locking bar being removably attachable to another part of said frame, thereby causing its central portion to bear against and immobilize said container;

wherein said rotatable frame is a substantially U-shaped tubular frame having a horizontal bar and a pair of vertical beams extending perpendicularly therefrom to define said space holding a container, each of said perpendicular beams being provided with one of said stop members so disposed as to overlap said protruding guides causing the positioning of said container in said frame to substantially align said protruding guides cooperating with said stop members with said vertical beams;

further comprising vertical stop members having the shape of steel plates and so disposed on said vertical beams as to overlap the top and bottom ends of said protruding guides on said container and thereby preventing vertical motion of said container with respect to said frame and further providing for imparting rotary motion to said container during rotation of said rotatable frame.

4. A tumbling machine for agitating and massaging foodstuffs under vacuum, comprising:

a base;

upstanding bearing posts mounted on said base and equipped with journals;

a rotatable frame, providing with extending coaxial shafts residing in said journals to permit rotation of said frame around a normally horizontal axis, said frame defining at least one space in which may be placed at least one container for said foodstuffs;

means, coupled to said rotatable frame, for imparting rotary motion to said frame around said axis;

at least one container for said foodstuffs, said container having guide means for insuring the location and position thereof in said rotatable frame, said guide means being defined by a plurality of uniformly spaced protruding guides fixedly mounted on the outside wall of said container, said container being provided with means for evacuating air therefrom;

said rotatable frame is provided with stop means so located that, when said container is placed in the space defined in said rotatable frame, at least some of said protruding guides come into contact with said stop means to thereby prevent further motion of said container with respect to said frame in the direction of entry;

a locking bar member for locking said container in said frame to prevent motion thereof with respect to said frame at least in the direction opposite to entry, said locking bar being held pivotably at one end thereof on said frame, the other end of said locking bar being removably attachable to another part of said frame, thereby causing its central portion to bear against and immobilize said container;

wherein said rotatable frame has a horizontal beam and extending perpendicularly therefrom vertical beams, each of said vertical beams being provided with a vertically extending stop member and associated with each stop member two horizontally extending fixedly attached vertical stop members extending adjacent the ends of a said protruding guide for limiting the vertical motion of said container.

5. A tumbling machine for agitating and massaging foodstuffs under vacuum, comprising:

support means equipped with journals;

a rotatable frame, provided with extending coaxial shafts resting in said journals to permit rotation of said frame about a normally horizontal axis, said frame defining a space within which may rest a container for the foodstuffs to be tumbled;

drive means to impart rotary motion to said frame to drive said frame about said normally horizontal axis;

a container for said foodstuffs, said container having guide means for locating and positioning said container in said rotatable frame, said guide means comprising a plurality of uniformly spaced protruding guides fixedly mounted on the outside wall of said container, and said container being provided with means for evacuating air therefrom;

stop means to prevent further motion of said container with respect to said frame in the direction of entry of said container into said frame, said stop means being so located on said rotatable frame that when said container is placed in the space defined in said rotatable frame, at least one of said protruding guides comes into contact with said stop means;

a locking bar member for locking said container in said frame to prevent motion thereof with respect to said frame at least in the direction opposite to entry, said locking bar being held pivotally at one end thereof on said frame about a vertical axis while the other end of said locking bar is removably attachable to another part of said frame, the central portion of said locking bar bearing against one of said protruding guides when said locking bar is locked into place; and means to prevent vertical motion of said container with respect to said frame comprising a pair of vertical stop members mounted on said frame and extending adjacent to the ends of a said protruding guide.

6. A tumbling machine according to claim 5, wherein said protruding guides are four sections of substantially rectangular tubing welded on the outside of said container in substantially vertical orientation at uniform intervals and extending over only a portion of the vertical height of said container.

7. A tumbling machine according to claim 5, wherein said rotatable frame is a U-shaped frame made from substantially rectangular tubes and provided with two vertical beams for said container, and wherein said coaxially extending shafts are rigidly attached to the external vertical beams, and there being further provided a clutch between said geared motor and one of said shafts.

8. A tumbling machine according to claim 5, further comprising a safety frame substantially surrounding said rotatable frame and said container, a door in said safety frame and a safety switch cooperating with said door whereby when said door is opened, said safety switch causes the arrest of the rotary motion of said frame.

9. A tumbling machine according to claim 8, further comprising operational control means attached to said safety frame for providing programmed rotary motion of said rotatable frame and said container.

10. A tumbling machine according to claim 5, wherein said container is substantially cylindrical and having a bottom surface provided with wheels, guide rails affixed in said base cooperating with said wheels whereby, during entry of said container into said tumbling machine, the lateral position of the container is defined, and said container being further provided with a removable top cover in which is provided a connection for attaching a vacuum line.

* * * * *